United States Patent [19]

Ferdico

[11] 4,058,863

[45] Nov. 22, 1977

[54] SWIMMING GLOVE

[76] Inventor: Vincent Ferdico, 85 Maplewood St., West Hempstead, N.Y. 11552

[21] Appl. No.: 760,671

[22] Filed: Jan. 19, 1977

[51] Int. Cl.[2] ..... A63B 31/02

[52] U.S. Cl. ..... 9/308

[58] Field of Search ..... 9/301, 307, 308

[56] References Cited

U.S. PATENT DOCUMENTS

| | | | |
|---|---|---|---|
| 1,014,939 | 1/1912 | Boman | 9/307 |
| 1,284,178 | 11/1918 | Clarke | 9/307 |
| 1,546,267 | 7/1925 | Tickel | 9/307 |
| 2,004,684 | 6/1935 | Bell | 9/308 |
| 3,231,910 | 2/1966 | Tegland | 9/308 |
| 3,397,414 | 8/1968 | Webb | 9/307 |

*Primary Examiner*—Trygve M. Blix
*Assistant Examiner*—D. W. Keen
*Attorney, Agent, or Firm*—Jesse Woldman

[57] ABSTRACT

A glove for increasing the efficiency of a swimmer includes an integral webbed elastic member having open-ended digit receiving tubular portions joined to one another by web portions reinforced at both ends by thickened ribs. An apertured extending portion encompasses the periphery of the wearer's palm and wrist to provide additional security of the glove to the wearer's hand.

5 Claims, 7 Drawing Figures

SWIMMING GLOVE

BACKGROUND OF THE INVENTION

1. Field of the Invention

The invention is directed to the field of aquatic devices for swimmers.

2. Description of the Prior Art

Various hand worn devices for assisting swimmers are known in the prior art. For example, U.S. Pat. No. 1,014,939 issued to E. Boman on Jan. 16, 1912; U.S. Pat. No. 1,284,178 issued to J. A. Clarke on Nov. 5, 1918; U.S. Pat. No. 2,726,410 issued to K. V. Adamopoulos on Dec. 13, 1955; U.S. Pat. No. 3,231,910 issued to A. L. Tegland on Feb. 1, 1966; and U.S. Pat. No. 3,938,207 issued to Drescher on Feb. 17, 1976 each disclose glove-like devices arranged to be worn on the hand of a swimmer to increase the efficiency of the swimming stroke. These devices, although representing an improvement over the unassisted hand in propelling the swimmer through the water, generally required a rather complex and expensive construction to provide the necessary support and freedom of movement essential for efficient use. For example, the Clarke device, although disclosing the webbed construction, lacked the means for securing the glove to the wearer's hand to prevent the loosening thereof during vigorous swimming strokes. This limitation is at least partially alleviated in the structures disclosed by Boman, Adamopoulos, Tegland, and Drescher, which further include wrist bands for securing the glove to the wearer's hand. Of the latter devices, none provides a simple, inexpensive, readily manufactured integral structure readily adopted to high volume, inexpensive molding techniques.

SUMMARY OF THE INVENTION

The invention overcomes the limitations and difficulties noted above with respect to prior art devices by providing a swimming glove which is simpler, more reliable, and less expensive than such prior art devices. The present invention includes an integrally formed elastic member having appropriately formed open-ended finger and thumb receiving tubular elements joined to one another by webbed portions and bordered preferably by thickened rib portions suitably located to provide reinforcement and stability thereto. A centrally exposed extending portion encircles the outer perimeter of the palm and wrist in such manner as to secure the device to the wearer's hand during the most vigorous swimming strokes. In one embodiment the web portion joining the thumb receiving portion to the forefinger receiving portion may be divided into juxtaposed segments hingedly joined to one another to provide greater freedom of movement. Thickened rib portions are further provided intermediate each pair of adjacently disposed digit receiving portions at a point closest to the palm area to assist the wearer in maintaing the digit receiving portions in a spread-apart configuration for maximum efficiency and reduced effort during use. The device is so designed as to permit the molding thereof as a single integral unit in high production and at a low cost from many commercially available suitable natural or synthetic elastic materials. It is therefore an object of this invention to provide an improved swimming glove.

It is another object of this invention to provide a means for increasing the efficiency of a swimmer.

It is a further object of this invention to provide a low cost swimming glove for swimmers.

It is still another object of this invention to provide a swimming glove which may be economically manufactured as a single piece integral unit.

It is yet another object of this invention to provide an improved swimming glove so structured as to maintain the finger portions in an outstretched condition for increased efficiency.

It is still a further object of this invention to provide a specially formed integral swimming glove having incorporated therein means for securing the glove to the hand of the wearer.

It is yet a further object of this invention to provide an improved universal swimming glove placeable on either hand of the wearer.

Other objects and features of the invention will be pointed out in the following description and claims and illustrated in the accompanying drawings which disclose, by way of example, the principal of the invention and the best mode contemplated for carrying it out .

BRIEF DESCRIPTION OF THE DRAWINGS

In the Drawings

Similar elements are given similar reference characters in each of the respective drawings.

DESCRIPTION OF THE PREFERRED EMBODIMENTS

Figure 1:
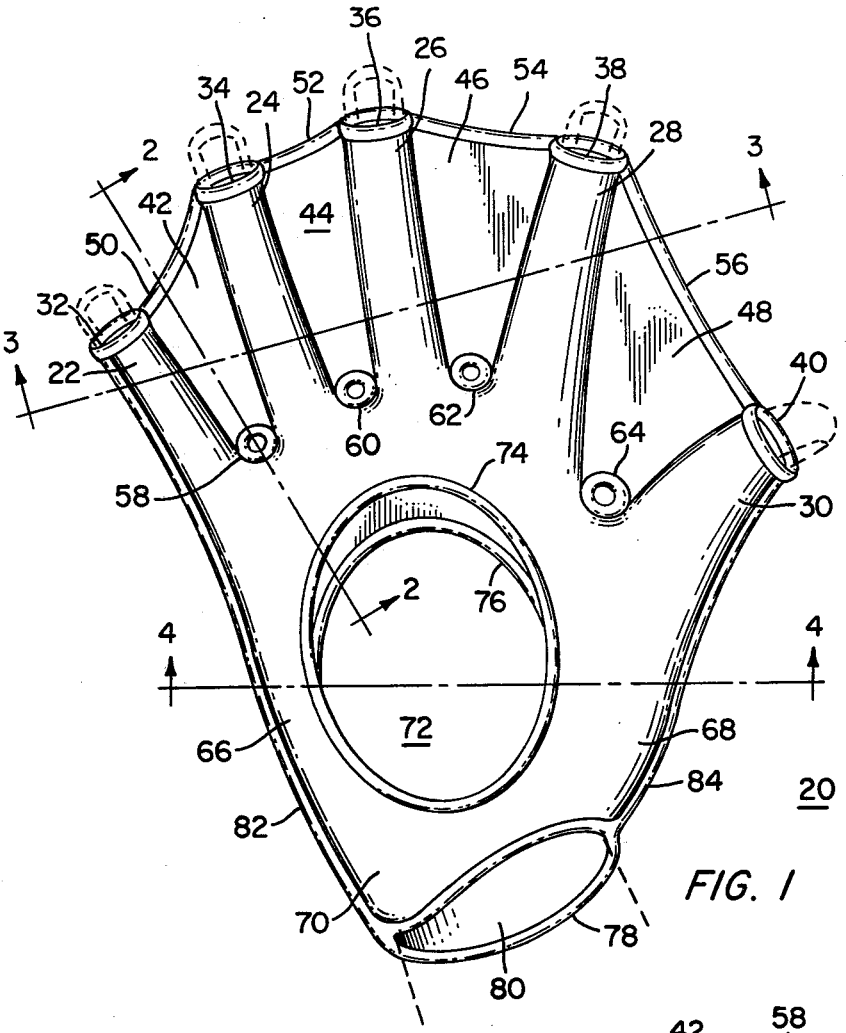
FIG. 1 is a front perspective view of a swimming glove constructed in accordance with the concepts of the invention.
Figure 2:
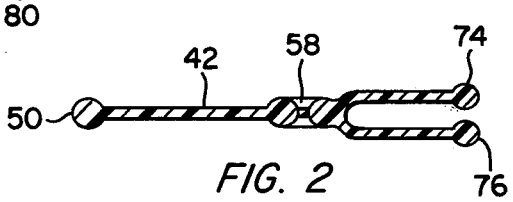
FIG. 2 is a sectional view taken along the line 2—2 of FIG. 1.
Figure 3:
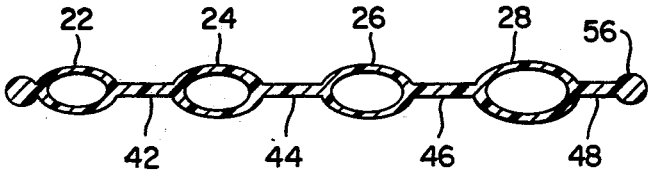
FIG. 3 is a sectional view taken along the line 3—3 of FIG. 1.
Figure 4:
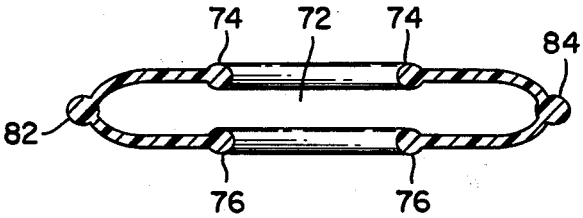
FIG. 4 is a sectional view taken along the line 4—4 of FIG. 1.

Turning now to FIGS. 1 through 4 there is shown a swimming glove 20 constructed in accordance with the concepts of the invention. The glove 20 is made preferably from suitable elastic flexible material which may include any one of a number of natural or synthetic materials, although a latex rubber material has been found to be highly desirable for such construction. In the embodiment illustrated in FIG. 1 the glove 20 is shown as including finger receiving portions 22, 24, 26 and 28 and a thumb receiving portion 30 each located in the usual manner so as to readily accept the fingers of a hand of the wearer. Each of the portions 22, 24, 26, 28, and 30, is formed as a flexible tubular element having a respective open end bordered by a respective thickened first rib portion 32, 34, 36, 38 and 40, and of such length as to permit the respective fingertips of the wearer to protrude beyond such ends, as shown in dotted outline in FIG. 1. The rib portions 32, 34, 36, 38, and 40 define restrictive openings of suitable dimension so as to fit snugly about the fingertips and provide preferably a water-tight seal at each location. Interconnecting each digit receiving portion to one another is a generally planar web portion indicated by the respective numerals 42, 44, 46, and 48. The web portions 42, 44, 46, and 48 are relatively thin, as illustrated in FIG. 2, thereby permitting the wearer to manipulate the fingers with a sufficient degree of freedom for both comfort and convenience. Each web portion 42, 44, 46, and 48 is bordered by a thickened rib portion 50, 52, 54, and 56, respectively, to assist in maintaining each respective web portion in a generally planar configuration and to resist its tendency to fold or collapse in use. The rib portions 50, 52, 54, and 56 are formed preferably contigurously with the rib portions 32, 34, 36, 38, and 40 to provide a continuous reinforcing bead along the outer edge of the glove 20 in the vicinity of the portions 22, 24, 26, 28, and 30. At the juncture between each adjacent pair of digit receiving portions 22, 24, 26, 28 and 30 is a respective thickened second rib portion 58, 60, 62, 64 having a generally annular configuration, as viewed in the plane of the glove 20. These portions 58, 60, 62, and 64 provide an additional measure of reinforcement for the respective web portions 42, 44, 46, and 48 while additionally tending to maintain the digit receiving portions 22, 24, 26, 28, and 30 in a spread-apart configuration. In this manner the maximum surface area of the web portions 42, 44, 46, and 48 is presented normal to the water for maximum efficiency during the conventional swimming stroke. The wearer is thus relieved of the exertion which would normally be required in maintaining the fingers of the hand in a spread-apart configuration against the force exerted by the water on each web portion 42, 44, 46, and 48, which would tend to buckle or collapse under such pressure. The remainder of the glove 20 comprises extending portions 66 and 68 which encircle the remainder of the hand of the wearer and which are joined by a strap-like wrist engaging portion 70, the extending portions 66 and 68 and the wrist engaging portion 70 being formed integrally with the web and digit receiving portions as a single unit. The elasticity of the material employed to form the glove 20 permits it to be manufactured in such sizes as to stretch over the wearer's hand and thus be securely held in place with the aid of the wrist engaging portion 70 and the encircling portions 66 and 68 despite vigorous swimming motions of the wearer. To provide further freedom of movement, enlarged transverse openings 72 are provided in the area of the palm and back of the hand of the wearer, a feature which also minimizes the drag of the glove 20 through the water in normal use. Bordering the openings 72 on both the front and back portions of the glove 20 is a respective thickened third rib portion 74, 76. The portions 74 and 76 provide both reinforcement in the area surrounding the openings 72 and at least a partial seal by sitting snugly against the portion of the palm and back of the hand directly adjacent thereto. An additional seal and reinforcement is provided by a further thickened rib portion 78 bordering an opening 80 through which the hand is inserted and removed. The rib portion 78 is arranged to encircle the wrist of the wearer above the other wrist encircling portion 70 of the glove 20. The outer periphery of the extending portions 66 and 68 are bordered by further thickened rib portions 82 and 84, rib portion 82 extending from rib portion 32 to rib portion 78, and rib portion 84 extending from rib portion 40 to rib portion 78 to provide a preferably continous reinforcing bead along the associated edges of the glove 20.

Figure 5:
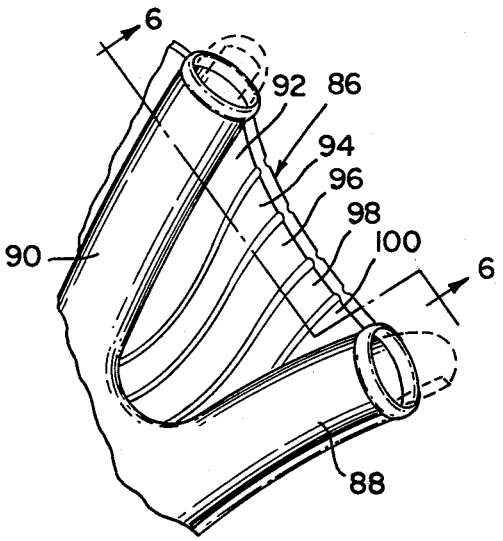
FIG. 5 is a fragmentary perspective view of a further embodiment of a webbed portion of a swimming glove constructed in accordance with the concepts of the invention.
Figure 6:
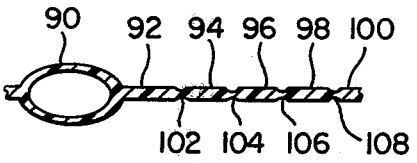
FIG. 6 is a fragmentary sectional view taken along the line 6—6 of FIG. 5.

Turning now to FIGS. 5 and 6 there is shown a further embodiment of a web portion 86 between a thumb receiving portion 88 and an adjacent finger receiving portion 90 of a swimming glove constructed in accordance with the concepts of the invention. In this case, the web portion 86, instead of being formed as a single planar member such as web portion 48 of FIG. 1, comprises a series of essentially planar segments 92, 94, 96, 98, 100 joined to one another by hinge portions 102, 104, 106, and 108 which are shown as elongate seams of reduced thickness. This feature enables the wearer to more readily manipulate the thumb and forefinger by applying sufficient pressure to the web portion 86 to cause the segments 92, 94, 96, 98, and 100 to fold or buckle somewhat so that the thumb and forefinger may be brought closer together, where necessary or desirable, to relieve any strain or discomfort which may result from maintaining the thumb and forefinger in a spread apart position for extended periods of use. Although the web portion 86 is shown as being divided into five segments, either more or less segments may be provided in like manner without departing from the spirit of the invention and within the concepts herein disclosed.

Figure 7:
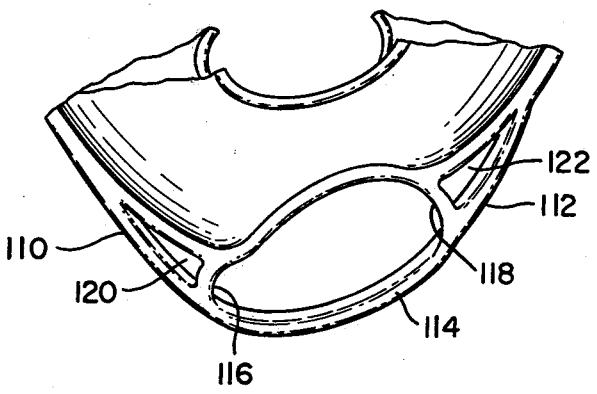
FIG. 7 is a fragmentary perspective view of a further embodiment of the wrist encircling portion of a swimming glove constructed in accordance with the concepts of the invention.

To provide universality in both manufacture and use, the glove 20 is provided with substantially identical front and back portions so contoured as to permit nonselective placement of the glove over either the right or left hand of the wearer with equal effectiveness and fit. This feature also serves to substantially reduce the tooling costs involved in the manufacture thereof, and, when combined with the elastic properties of the glove 20 which permit a single size to be applicable for a large range of hand sizes, further reduces the manufacturing costs associated therewith. The rib portions 82 and 84 may be modified, as shown in FIG. 7, to provide a bifurcated end portion 110, 112, respectively, at the juncture with the rib portion 78 bordering the wrist encircling portion 70. The bifurcated end portions 110 and 112 provide an additional measure of resiliency and expansion at the wrist of the wearer. This is accomplished by providing a wrist encircling rib portion 114 having segments 116 and 118 of reduced thickness at the junctures between the rib portion 114 and the bifurcated end portions 110 and 112. It will also be noted that the openings 120 and 122 formed by the diverging segments of the respective end portions 110 and 112 may be arranged to receive the fingers of the opposite hand (not shown) for applying and removing the swimming glove in a more convenient manner.

The embodiments of the invention in which an exclusive property or privilege is claimed are defined as follows:

1. A swimming glove for placement over the hand, comprising: an integral elastic member having hollow elongate finger receiving portions and a hollow elongate thumb receiving portion, each of said portions being joined to one another by web portions, said elastic member having an integral extended palm and wrist receiving portion with an enlarged transverse opening therein for exposing the palm and the back of the hand of the wearer while encircling and grasping the outer perimeter of the hand and wrist of the wearer, there being a thickened first rib portion extending about the periphery of said elastic member to provide reinforcing means therefor, each adjacent pair of said finger receiving portions converging together at a juncture remote from the free end of said finger receiving portions, each of said junctures having located thereat a thickened second rib portion having an annular contour in the plane of said swimming glove for maintaining said finger receiving portions in spread apart relationship.

2. A swimming glove as defined in claim 1 wherein said web portion joining said thumb receiving portion to said finger receiving portion adjacent thereto comprises a series of planar segments of uniform thickness joined to one another by a hinge portion of reduced cross section.

3. A swimming glove as defined in claim 1 further comprising a thickened third rib portion bordering said enlarged transverse opening to provide additional reinforcement thereat.

4. A swimming glove as defined in claim 3 wherein said thumb receiving portion and said finger receiving portions are selectively shortened so as to provide an open end portion arranged to expose the fingertips of the wearer, said thickened first rib portion extending about the periphery of each of said open end portions being arranged to provide a water tight seal about a respective fingertip of the wearer.

5. A swimming glove as defined in claim 4 wherein said elastic member has substantially identical front and back portions for non-selective placement over either hand of the wearer, said front and said back portions being joined together so as to define a restrictively contoured hand receiving opening having a border arranged to fit tightly about the wrist of the wearer, there being bifurcated fourth rib portions adjacent said border to provide increased expansion thereat, said fourth rib portions joining said first rib portion to said border at two diametrically opposed locations, said fourth rib portions being arranged in pairs, each pair diverging from said first rib portion and joining said border at spaced apart junctures to provide a segment of said border therebetween.

* * * * *